US011471921B2

(12) United States Patent
Salters et al.

(10) Patent No.: US 11,471,921 B2
(45) Date of Patent: Oct. 18, 2022

(54) COOLING APPARATUS FOR COOLING A FLUID BY MEANS OF SURFACE WATER

(71) Applicant: KONINKLIJKE PHILIPS N.V., Eindhoven (NL)

(72) Inventors: Bart Andre Salters, Eindhoven (NL); Roelant Boudewijn Hietbrink, Utrecht (NL)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 16/795,984

(22) Filed: Feb. 20, 2020

(65) Prior Publication Data

US 2020/0188969 A1 Jun. 18, 2020

Related U.S. Application Data

(63) Continuation of application No. 15/534,752, filed as application No. PCT/EP2015/079448 on Dec. 11, 2015, now abandoned.

(30) Foreign Application Priority Data

Dec. 12, 2014 (EP) ..... 14197749

(51) Int. Cl.
*F28F 19/00* (2006.01)
*B08B 7/00* (2006.01)
(Continued)

(52) U.S. Cl.
CPC ..... *B08B 7/0057* (2013.01); *B08B 17/02* (2013.01); *F01P 11/06* (2013.01); *F28D 1/022* (2013.01);
(Continued)

(58) Field of Classification Search
None
See application file for complete search history.

(56) References Cited

U.S. PATENT DOCUMENTS 4,778,653 A 10/1988 Kamimura et al.
9,562,718 B2 2/2017 Hodges
(Continued)

FOREIGN PATENT DOCUMENTS

CN 101663769 A 3/2010
DE 102008006464 A1 1/2009
(Continued)

OTHER PUBLICATIONS

Müller-Steinhagen, H., "Heat Exchanger Fouling: Mitigation and Cleaning Technologies", pp. 220-221, Sep. 2000.

*Primary Examiner* — Eric W Golightly

(57) ABSTRACT

A cooling apparatus for cooling a fluid by means of surface water, the cooling apparatus comprising more than one tubes for containing and transporting the fluid in its interior, the exterior of the tube being in operation at least partially submerged in the surface water so as to cool the tube to thereby also cool the fluid and hence different tube portions contain fluid at different temperatures. The cooling apparatus further comprises at least one light source for producing light that hinders fouling on the submerged exterior, wherein the at least one light source is arranged so that the intensity of the anti-fouling light, cast over the exterior of the tube portions whose exterior temperature or the temperature of the fluid they contain is below 80° C., is higher than the intensity of the anti-fouling light cast over the other tube portions. By this structure anti-fouling of the cooling apparatus can be assured in an effective manner.

20 Claims, 3 Drawing Sheets

(51) Int. Cl.

| | |
|---|---|
| ***F28D 1/02*** | (2006.01) |
| ***B08B 17/02*** | (2006.01) |
| ***F28F 19/04*** | (2006.01) |
| ***F01P 11/06*** | (2006.01) |
| ***F28F 1/02*** | (2006.01) |
| ***F28D 1/047*** | (2006.01) |

(52) U.S. Cl.
CPC ..... *F28D 1/0475* (2013.01); *F28F 1/022* (2013.01); *F28F 19/00* (2013.01); *F28F 19/04* (2013.01); *F01P 2050/06* (2013.01); *F28F 2265/20* (2013.01)

(56) References Cited

U.S. PATENT DOCUMENTS

| | | | |
|---|---|---|---|
| 2013/0283766 | A1 | 10/2013 | Primus |
| 2014/0196745 | A1 | 7/2014 | Whelan et al. |
| 2014/0231058 | A1 | 8/2014 | Nakamura |

FOREIGN PATENT DOCUMENTS

| | | | |
|---|---|---|---|
| DE | 102010052446 | A1 | 2/2012 |
| EP | 2127518 | A1 | 12/2009 |
| EP | 2485003 | A1 | 8/2012 |
| JP | 5023502 | A | 2/1993 |
| WO | 0125086 | A1 | 4/2001 |
| WO | 2001045086 | A2 | 6/2001 |
| WO | 2011078771 | A1 | 6/2011 |

COOLING APPARATUS FOR COOLING A FLUID BY MEANS OF SURFACE WATER

CROSS-REFERENCE TO PRIOR APPLICATIONS

This application is a continuation of U.S. application Ser. No. 15/534,752 filed Jun. 9, 2017 which is the U.S. National Phase application under 35 U.S.C. § 371 of International Application No. PCT/EP2015/079448, filed on 11 Dec. 2015, which claims the benefit of European Patent Application No. 14197749.6, filed on 12 Dec. 2014. These applications are hereby incorporated by reference herein.

FIELD OF THE INVENTION

The present disclosure relates to a cooling apparatus which is adapted for the prevention of fouling, commonly referred to as anti-fouling. The disclosure specifically relates to anti-fouling of the sea box coolers.

BACKGROUND OF THE INVENTION

Bio fouling or biological fouling is the accumulation of microorganisms, plants, algae, and/or animals on surfaces. The variety among bio fouling organisms is highly diverse and extends far beyond attachment of barnacles and seaweeds. According to some estimates, over 1800 species comprising over 4000 organisms are responsible for bio fouling. Bio fouling is divided into micro fouling which includes biofilm formation and bacterial adhesion, and macro fouling which is the attachment of larger organisms. Due to the distinct chemistry and biology that determine what prevents them from settling, organisms are also classified as hard or soft fouling types. Calcareous (hard) fouling organisms include barnacles, encrusting bryozoans, mollusks, polychaete and other tube worms, and zebra mussels. Examples of non-calcareous (soft) fouling organisms are seaweed, hydroids, algae and biofilm "slime". Together, these organisms form a fouling community.

In several circumstances bio fouling creates substantial problems. Machinery stop working, water inlets get clogged, and heat exchangers suffer from reduced performance. Hence the topic of anti-fouling, i.e. the process of removing or preventing bio fouling from forming, is well known. In industrial processes, bio-dispersants can be used to control bio fouling. In less controlled environments, organisms are killed or repelled with coatings using biocides, thermal treatments or pulses of energy. Nontoxic mechanical strategies that prevent organisms from attaching include choosing a material or coating with a slippery surface, or creation of nanoscale surface topologies similar to the skin of sharks and dolphins which only offer poor anchor points.

Antifouling arrangements for cooling units that cool the engine fluid of a ship via seawater are known in the art. DE102008029464 relates to a sea box cooler comprising an antifouling system by means of regularly repeatable overheating. Hot water is separately supplied to the heat exchanger tubes so as to minimize the fouling propagation on the tubes.

SUMMARY OF THE INVENTION

Bio fouling on the inside of box coolers causes severe problems. The main issue is a reduced capacity for heat transfer as the thick layers of bio-fouling are effective heat insulators. As a result, the ship engines have to run at a much lower speed, slowing down the ship itself, or even come to a complete halt, due to over-heating.

There are numerous organisms that contribute to bio fouling. This includes very small organisms like bacteria and algae, but also very large ones such as crustaceans. The environment, temperature of the water, and purpose of the system all play a role here. The environment of a box cooler is ideally suited for bio-fouling: the fluid to be cooled heats up to a medium temperature and the constant flow of water brings in nutrients and new organisms.

Accordingly methods and apparatus are necessary for anti-fouling. Prior art systems, however, may be inefficient in their use, require regular maintenance and in most cases result in ion discharge to the sea water with possible hazardous effects.

Hence, it is an aspect of the invention to provide a cooling apparatus for the cooling of a ships engine with an alternative anti-fouling system according to the appended independent claims. The dependent claims define advantageous embodiments.

Herewith an approach is presented based on optical methods, in particular using ultra-violet light (UV). It appears that most micro-organisms are killed, rendered inactive or unable to reproduce with 'sufficient' UV light. This effect is mainly governed by the total dose of UV light. A typical dose to kill 90% of a certain micro-organism is 10 mW-hours per square meter. However it is known that biological fouling is a strong function of temperature. At higher temperatures chemical and enzyme reactions proceed at a higher rate with a consequent increase in cell growth rate. If however temperature rises to even higher level heat sensitive cells starts to die and eventually organisms get damaged and killed.

The cooling apparatus for the cooling of a ships engine is suitable to be placed in a closed box that is defined by the hull of the ship and partition plates. Entry and exit openings are provided on the hull so that sea water can freely enter the box volume, flow over the cooling apparatus and exit via natural flow. The cooling apparatus comprises a bundle of tubes through which a fluid to be cooled can be conducted and at least one light source for generating an anti-fouling light, arranged so that higher intensity of anti-fouling light is cast over the exterior of the tube portions whose exterior temperature and/or the temperature of the fluid contained in the interior of the said is below 80° C. Accordingly effective and efficient antifouling on the outer surfaces of the tubes is achieved.

In an embodiment of the cooling apparatus the anti-fouling light emitted by the light source is in the UV or blue wavelength range from about 220 nm to about 420 nm, preferably about 260 nm. Suitable anti-fouling levels are reached by UV or blue light from about 220 nm to about 420 nm, in particular at wavelengths shorter than about 300 nm, e.g. from about 240 nm to about 280 nm which corresponds to what is known as UV-C. Anti-fouling light intensity in the range of 5-10 $mW/m^2$ (milliwatts per square meter) can be used.

The light source may be a lamp having a tubular structure in an embodiment of the cooling apparatus. For these light sources as they are rather big the light from a single source is generated over a large area. Accordingly it is possible to achieve the desired level of anti-fouling with a limited number of light sources which render the solution rather cost effective.

The most efficient source for generating UVC is the low-pressure mercury discharge lamp, where on average 35% of input watts is converted to UVC watts. The radiation is generated almost exclusively at 254 nm viz. at 85% of the maximum germicidal effect (FIG. 3). Philips' low pressure tubular fluorescent ultraviolet (TUV) lamps have an envelope of special glass that filters out ozone-forming radiation, in this case the 185 nm mercury line.

For various Philips germicidal TUV lamps the electrical and mechanical properties are identical to their lighting equivalents for visible light. This allows them to be operated in the same way i.e. using an electronic or magnetic ballast/starter circuit. As with all low pressure lamps, there is a relationship between lamp operating temperature and output. In low pressure lamps the resonance line at 254 nm is strongest at a certain mercury vapour pressure in the discharge tube. This pressure is determined by the operating temperature and optimises at a tube wall temperature of 40° C., corresponding with an ambient temperature of about 25° C. It should also be recognised that lamp output is affected by air currents (forced or natural) across the lamp, the so called chill factor. The reader should note that, for some lamps, increasing the air flow and/or decreasing the temperature can increase the germicidal output. This is met in high output (HO) lamps viz. lamps with higher wattage than normal for their linear dimension.

A second type of UV source is the medium pressure mercury lamp, here the higher pressure excites more energy levels producing more spectral lines and a continuum (recombined radiation) (FIG. 6). It should be noted that the quartz envelope transmits below 240 nm so ozone can be formed from air. Advantages of medium pressure sources are:

- high power density;
- high power, resulting in fewer lamps than low pressure types being used in the same application; and
- less sensitivity to environment temperature.

The lamps should be operated so that the wall temperature lies between 600 and 900° C. and the pinch does not exceed 350° C. These lamps can be dimmed, as can low pressure lamps.

Further, Dielectric Barrier Discharge (DBD) lamps can be used. These lamps can provide very powerful UV light at various wavelengths and at high electrical-to-optical power efficiencies.

The germicidal doses needed can also easily be achieved with existing low cost, lower power UV LEDs. LEDs can generally be included in relatively smaller packages and consume less power than other types of light sources. LEDs can be manufactured to emit (UV) light of various desired wavelengths and their operating parameters, most notably the output power, can be controlled to a high degree.

In an embodiment of the cooling apparatus the at least one light source is dimensioned and positioned with respect to the tube so that substantially no anti-fouling light is cast over the exterior of the tube portions whose temperature and/or the temperature of the fluid contained within is more than or equal to 90° C. Accordingly use of unnecessary light sources is avoided.

In an embodiment of the cooling apparatus the at least one light source is dimensioned and positioned with respect to the tube so that anti-fouling light is cast over the substantially the whole exterior of the tube portions whose temperature is within the range of 35–55° C. Accordingly efficiency of anti-fouling is guaranteed.

In an embodiment of the cooling apparatus more than one light source are positioned in an asymmetric manner with respect to the tubes. By way of this embodiment, efficient antifouling is achieved while avoiding unnecessary costs and power consumption.

In an embodiment the cooling apparatus comprises a tube plate on which the tubes are mounted, and connected to the tube plate a fluid header comprising one inlet stub and one outlet stub for the entry and the exit of the fluid to and from the tubes respectively, characterized in that at least one light source is positioned close to the tube portions connected to the outlet stub.

In a version of the above described embodiment the cooling apparatus comprises a tube bundle comprising tube layers arranged in parallel along its width such that each tube layer comprises a plurality of hairpin type tubes having two straight tube portions and one semicircular portion so as to form a U-shaped tube and wherein the tubes are disposed with U-shaped tube portions concentrically arranged and straight tube portions arranged in parallel, so that the innermost U-shaped tube portions are of relatively small radius and the outermost U-shaped tube portions are of relatively large radius, with the remaining intermediate U-shaped tube portions are of progressively graduated radius of curvature disposed there-between wherein at least one light source is arranged at the inner side of the tube bundle and at least one light source is arranged only at one of the outer sides of the tube bundle which corresponds to the straight tube portions receiving fluid from the outlet stub.

In a version of the above described embodiment of the cooling apparatus three light sources are arranged at the inner side of the tube bundle and two light sources are arranged at the outer sides of the tube bundle which corresponds to the straight tube portions receiving fluid from the outlet stub.

In another embodiment the cooling apparatus comprises a tube plate on which the tubes are mounted and a fluid header connected to the tube plate, said header comprising at least two inlet stubs through which fluid at different temperatures enter and at least one outlet stub for the entry and the exit of the fluid to and from the tubes respectively, wherein that at least one light source is positioned close to the tube portions connected to the inlet stub through which fluid below 80° C. enters and/or the outlet stub.

In another embodiment the cooling apparatus comprises at least one sensor for sensing the temperature of the fluid contained in the interior of the tube portions and/or the temperature of the exterior of the tube portions, at least one light source coupled the sensor and control unit that controls the activity and the intensity of the light source based on the temperature sensed by the sensor that the light source is coupled to.

In a version of the above described embodiment the control unit switches on the light source when the temperature sensed by the sensor coupled to the light source is below 80° C. Hence by this embodiment effective antifouling is achieved.

In a version of the above described embodiment the control unit switches off the light source when the temperature sensed by the sensor coupled to the light source is above 80° C. Hence by this embodiment efficient antifouling is achieved along with optimal power consumption.

In another version of the above described embodiment the control unit increases the intensity of the light source when the temperature sensed by the sensor coupled to the light source is below 80° C. Similarly by this embodiment efficient antifouling is achieved along with optimal power consumption.

In a further version of the above described embodiment the control unit decreases the intensity of the light source when the temperature sensed by the sensor coupled to the light source is above 80° C. Similarly by this embodiment efficient antifouling is achieved along with optimal power consumption.

In an embodiment of the cooling apparatus the tubes are at least partially coated with a light reflective coating. Accordingly the antifouling light would reflect in a diffuse way and hence light is distributed more effectively over the tubes.

The invention also provides a ship comprising a cooling unit for cooling of the ship's engine as described above. In such an embodiment the inner surfaces of the box in which the cooling unit is placed may at least partially coated with a light reflective coating. Similarly to the embodiment above as a result of this particular embodiment the anti-fouling light would reflect in a diffuse way and hence light is distributed more effectively over the tubes.

The term "substantially" herein, will be understood by the person skilled in the art. The term "substantially" may also include embodiments with "entirely", "completely", "all", etc. Hence, in embodiments the adjective substantially may also be removed. Where applicable, the term "substantially" may also relate to 90% or higher, such as 95% or higher, especially 99% or higher, even more especially 99.5% or higher, including 100%. The term "comprise" includes also embodiments wherein the term "comprises" means "consists of". The term "comprising" may in an embodiment refer to "consisting of" but may in another embodiment also refer to "containing at least the defined species and optionally one or more other species".

It is to be understood that the terms so used are interchangeable under appropriate circumstances and that the embodiments of the invention described herein are capable of operation in other sequences than described or illustrated herein.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The article "a" or "an" preceding an element does not exclude the presence of a plurality of such elements. The mere fact that certain measures are recited in mutually different dependent claims does not indicate that a combination of these measures cannot be used to advantage.

The invention further applies to a device comprising one or more of the characterizing features described in the description and/or shown in the attached drawings.

The various aspects discussed in this patent can be combined in order to provide additional advantages. Furthermore, some of the features can form the basis for one or more divisional applications.

BRIEF DESCRIPTION OF THE DRAWINGS

Embodiments of the invention will now be described, by way of example only, with reference to the accompanying schematic drawings in which corresponding reference symbols indicate corresponding parts, and in which.

DETAILED DESCRIPTION OF EMBODIMENTS

Figure 1:
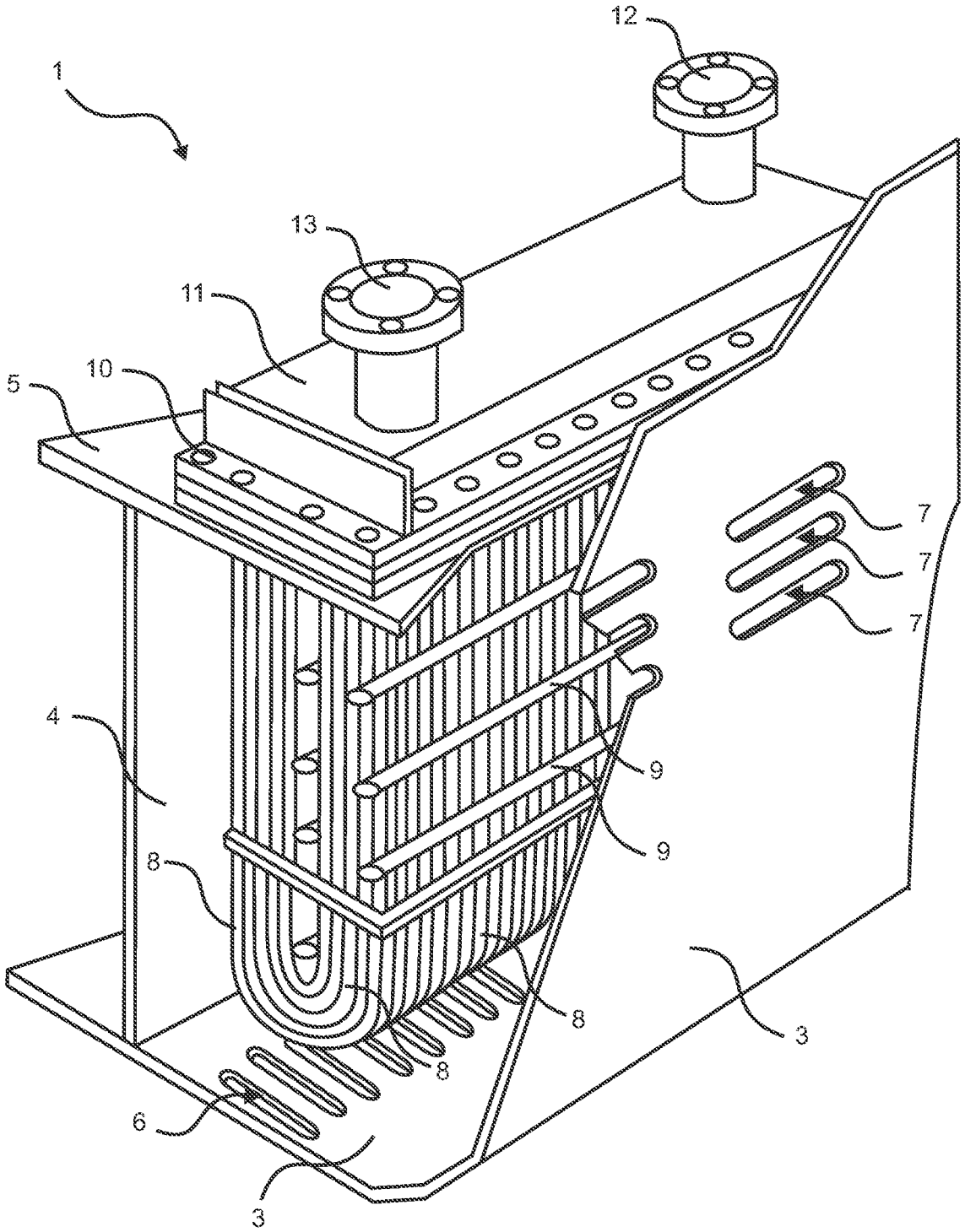
FIG. 1 is a schematic representation of an embodiment of the cooling apparatus.

While the disclosure has been illustrated and described in detail in the drawings and foregoing description, such illustration and description are to be considered illustrative or exemplary and not restrictive; the disclosure is not limited to the disclosed embodiments. It is further noted that the drawings are schematic, not necessarily to scale and that details that are not required for understanding the present invention may have been omitted. The terms "inner", "outer", "along", "longitudinal", "bottom" and the like relate to the embodiments as oriented in the drawings, unless otherwise specified. Further, elements that are at least substantially identical or that perform an at least substantially identical function are denoted by the same numeral.

FIG. 1 shows as a basic embodiment, a schematic view of a cooling apparatus (1) for the cooling of a ship's engine, placed in a closed box, defined by the hull (3) of the ship and partition plates (4,5) such that entry and exit openings (6,7) are provided on the hull so that sea water can freely enter the box volume, flow over the cooling apparatus and exit via natural flow, comprising a bundle of tubes (8) through which a fluid to be cooled can be conducted, at least one light source (9) for generating an anti-fouling light, arranged by the tubes (8) so as to emit the anti-fouling light on the tubes (8). Hot fluid enters the tubes (8) from above and conducted all the way and exits once again, now cooled from the top side. Meanwhile sea water enters the box from the entry openings (6), flows over the tubes (8) and receives heat from the tubes (8) and thus the fluid conducted within. Taking the heat from the tubes (8) sea water warms up and rises. The sea water then exits the box from the exit openings (7) which are located at a higher point on the hull (3). During this cooling process any bio organisms existing in the sea water tend to attach to the tubes (8) which are warm and provide a suitable environment for the organisms to live in, the phenomena known as fouling. To avoid such attachment at least one light source (9) is arranged by the tubes (8). The light source (9) emits the anti-fouling light on the outer surface of the tubes (8). As illustrated in FIG. 1 one or more tubular lamps can be used as a light source (9) to realize the aim of the invention.

Figure 2:
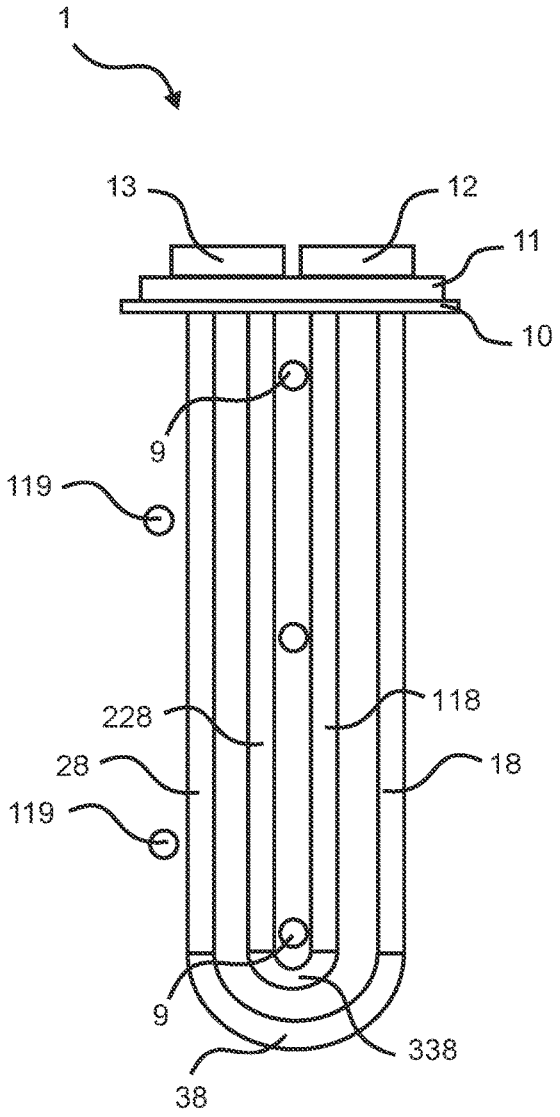
FIG. 2 is a schematic vertical cross section view of an embodiment of the cooling apparatus.

FIG. 2 shows one embodiment of the cooling unit (1). In this embodiment the cooling unit (1) comprises a tube plate (10) on which the tubes (8) are mounted. A fluid header (11) is connected to the tube plate (10) which comprises at least one inlet stub (12) and one outlet stub (13) for the entry and the exit of the fluid to and from the tubes (8) respectively. In this embodiment at least one light source (9) is positioned close to the tube portions (28, 228) connected to the outlet stub (13). In this embodiment the cooling unit (1) comprises a tube bundle having tube layers arranged in parallel along its width such that each tube layer comprises a plurality of hairpin type tubes (8) having two straight tube portions (18, 28) and one semicircular portion (38) so as to form a U-shaped tube (8). The tubes (8) are disposed with U-shaped tube portions (38) concentrically arranged and straight tube portions (18, 28) arranged in parallel. In this embodiment three light sources (9) are arranged at the inner side of the tube bundle and two light sources (119) are arranged at the outer sides of the tube bundle which corresponds to the straight tube portions (28, 228) connected to the outlet stub (13). Obviously other configurations are also possible.

Figure 3:
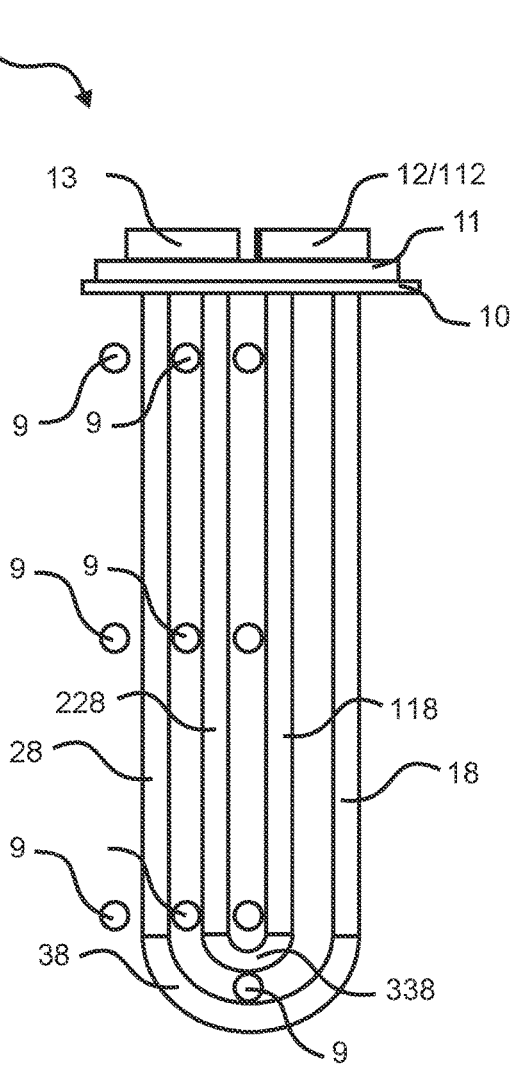
FIG. 3 is a schematic vertical cross section view of another embodiment of the cooling apparatus.

In an alternative embodiment shown in FIG. 3 the cooling apparatus (1) comprises a tube plate (10) on which the tubes (8) are mounted and a fluid header (11) connected to the tube plate (10). In this embodiment said header (11) comprises at least two inlet stubs (12, 112) through which fluid at different temperatures enter and at least one outlet stub (13) for the entry and the exit of the fluid to and from the tubes (8) respectively. At least one light source (9) is positioned close to the tube portion (118) connected to the inlet stub (112) through which fluid below 80° C. enters. In this embodiment light sources (9) are arranged in between the tubes (8) as well as on the outer and the inner side of the tube bundle.

Figure 4:
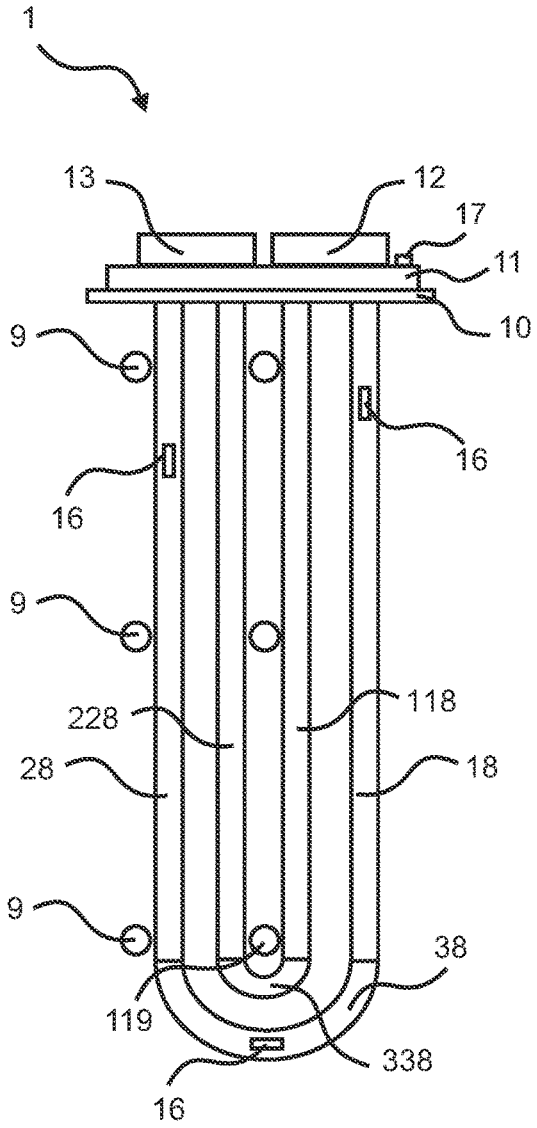
FIG. 4 is a schematic vertical cross section view of a further embodiment of the cooling apparatus.
Figure 5:
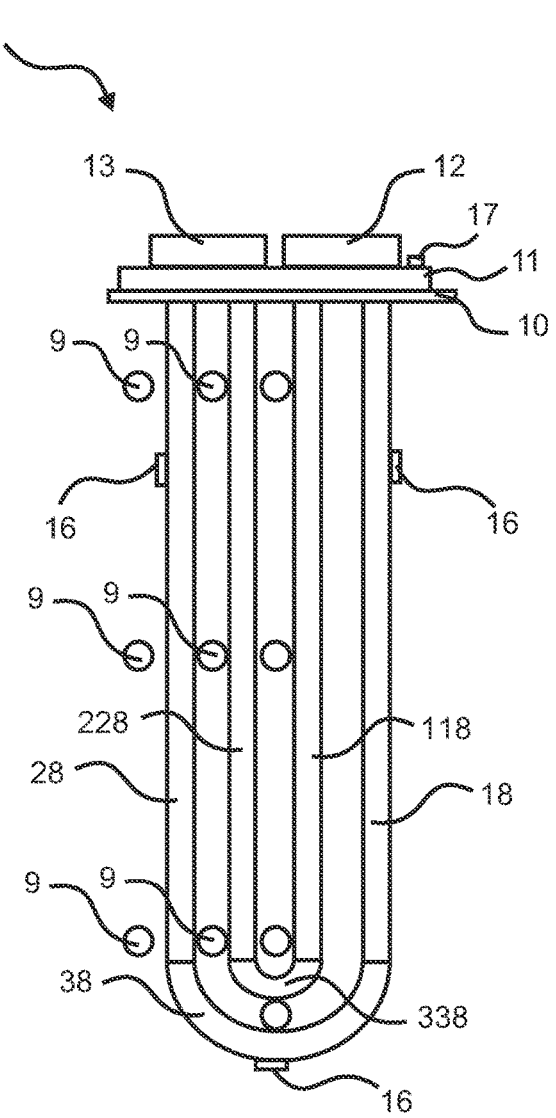
FIG. 5 is a schematic vertical cross section view of another embodiment of the cooling apparatus; and The drawings are not necessarily on scale.

In another embodiment of the invention as illustrated in FIGS. 4 and 5 the cooling apparatus (1) comprises at least one sensor (16) for sensing the temperature of the fluid contained in the interior of the tube portions (18, 28, 38, 118, 228, 338) and/or the temperature of the exterior of the tube portions (18, 28, 38, 118, 228, 338). In this embodiment the cooling apparatus (1) further comprises at least one light source (9) coupled the sensor (16) and a control unit (17) that controls the activity and the intensity of the light source (9) based on the temperature sensed by the sensor (16) that the light source (9) is coupled to. In the different embodiments illustrated in FIGS. 4 and 5 the sensors (16) are arranged in contact with the fluid contained in the interior tube portions (18, 28, 38, 118, 228, 338) or with the exterior of the tube portions (18, 28, 38, 118, 228, 338) respectively. The control unit (17) controls the power and the intensity of the light source (9) so that the anti-fouling light casted on the exterior of the tube portions (28, 228) for which the coupled sensor (16) senses a temperature below 80° C. is higher than the tube portions (18, 38, 118, 338) for which the coupled sensor (16) senses a temperature above 80° C.

Elements and aspects discussed for or in relation with a particular embodiment may be suitably combined with elements and aspects of other embodiments, unless explicitly stated otherwise. The invention has been described with reference to the preferred embodiments. Modifications and alterations may occur to others upon reading and understanding the preceding detailed description. It is intended that the invention be construed as including all such modifications and alterations insofar as they come within the scope of the appended claims or the equivalents thereof. As fouling may also happen in rivers or lakes, the invention is generally applicable to cooling by means of any kind of surface water.

The invention claimed is:

1. A cooling apparatus comprising:

at least two tubes, wherein each of the at least two tubes has an interior surface and an exterior surface, wherein the at least two tubes are arranged to contain and transport a fluid, wherein a first tube portion of the at least two tubes contains a first portion of fluid which is above 80° C. and a second tube portion of the at least two tubes contains fluid which is below or equal to 80° C.; and at least one light source, wherein the at least one light source produces a light, wherein the light hinders fouling on at least a portion of the exterior surface, wherein the at least one light source is arranged such that an intensity of the light cast over the exterior of the first tube portion is substantially lower than the intensity of the light cast over the exterior of the second tube portion.

2. A cooling apparatus according to claim 1, wherein at least a third portion of the at least two tubes contains a third portion of fluid which is above 90° C., wherein the at least one light source arranged with respect to the at least two tubes so that substantially none of the light is cast over the exterior of the third tube portion.

3. A cooling apparatus according to claim 1, wherein the at least one light source comprises a plurality of light sources, wherein the plurality of light sources are positioned in an asymmetric manner with respect to the at least two tubes.

4. A cooling apparatus according to claim 1, further comprising:

a tube plate, wherein the at least two tubes are mounted to the tube plate; and a fluid header comprising one inlet stub and one outlet stub, wherein the fluid header is connected to the tube plate, wherein the inlet stub is arranged for entry of the fluid and the outlet stub is arranged for exit of the fluid, wherein a fourth portion of the at least two tubes is connected to the outlet stub, wherein the at least one light source is positioned close to the fourth portion of the at least two tubes.

5. A cooling apparatus according to claim 4, wherein the at least two tubes comprise a tube bundle, the tube bundle having an innermost portion and an outermost portion, wherein the tube bundle comprises tube layers arranged in parallel such that each tube layer comprises a plurality of hairpin turns, wherein the hairpin turn are formed with at least two tubes having two straight tube portions and one semicircular portion thus forming a U-shaped portion, wherein the U-shaped tube portions are arranged concentrically, wherein the straight tube portions are arranged in parallel such that the innermost U-shaped tube portions have a relatively small radius and the outermost U-shaped tube portions have a relatively large radius, wherein at least one light source is arranged at the innermost portion, wherein at least one light source is arranged only at one of the outermost portions.

6. A cooling apparatus according to claim 5, wherein that at least one light source comprises at least five light sources, wherein the at least three lights sources are arranged at the innermost portion, wherein at least two light sources are arranged at the outermost portion.

7. A cooling apparatus according to claim 1, further comprising:

a tube plate, wherein the at least two tubes are mounted to the tube plate; and a fluid header comprising one inlet stub and one outlet stub, wherein the fluid header is connected to the tube plate, wherein the inlet stub is arranged for entry of the fluid and the outlet stub is arranged for exit of the fluid, wherein a fourth portion of the at least two tubes is connected to the outlet stub, wherein the at least one light source is positioned close to the fourth portion of the at least two tubes.

8. A cooling apparatus according to claim 1, further comprising:

at least one sensor, wherein the at least one sensor is arranged to sense a temperature of the fluid, wherein the at least one light source is coupled to the at least one sensor; and a control circuit, wherein the control circuit controls an activity and an intensity of the light source based on the temperature sensed by the sensor.

9. A cooling apparatus according to claim 8, wherein the control circuit switches the light source on when the temperature sensed by the sensor is below 80° C.

10. A cooling apparatus according to claim 8, wherein the control circuit switches the light source off when the temperature sensed by the sensor is above 80° C.

11. A cooling apparatus according to claim 8, wherein the control circuit increases the intensity of the light source when the temperature sensed by the sensor is below 80° C.

12. A cooling apparatus according to claim 8, wherein the control circuit decreases the intensity of the light source when the temperature sensed by the sensor is above 80° C.

13. A cooling apparatus according to claim 1, wherein the at least two tubes are at least partially coated with a light reflective coating.

14. A ship comprising a cooling apparatus according to claim 1, wherein the apparatus is arranged to cool the ship's engine.

15. A ship according to claim 14, wherein the ship comprises a hull, wherein the cooling apparatus is placed in a chamber, wherein the chamber is defined by the hull and a plurality of partition plates, wherein the chamber comprises entry and exit openings within the hull such that sea water can freely enter the interior of the chamber, flow over the cooling apparatus and exit via natural flow, wherein the chamber has an inner surface, wherein the inner surface of the chamber is at least partially coated with a light reflective coating.

16. A cooling apparatus according to claim 2, wherein the at least one light source comprises a plurality of light sources, wherein the plurality of light sources are positioned in an asymmetric manner with respect to the at least two tubes.

17. A cooling apparatus according to claim 3, further comprising:

a tube plate, wherein the at least two tubes are mounted to the tube plate; and a fluid header comprising one inlet stub and one outlet stub, wherein the fluid header is connected to the tube plate, wherein the inlet stub is arranged for entry of the fluid and the outlet stub is arranged for exit of the fluid, wherein a fourth portion of the at least two tubes is connected to the outlet stub, wherein the at least one light source is positioned close to the fourth portion of the at least two tubes.

18. A cooling apparatus according to claim 1, further comprising:

at least one sensor, wherein the at least one sensor is arranged to sense a temperature of a portion of the exterior surface, wherein the at least one light source is coupled to the at least one sensor; and a control circuit, wherein the control circuit controls an activity and an intensity of the light source based on the temperature sensed by the sensor.

19. A cooling apparatus according to claim 9, wherein the control circuit switches the light source off when the temperature sensed by the sensor is above 80° C.

20. A cooling apparatus according to claim 8, wherein the control circuit decreases the intensity of the light source when the temperature sensed by the sensor is above 80° C.

* * * * *